US006945293B1

(12) United States Patent
Newton

(10) Patent No.: US 6,945,293 B1
(45) Date of Patent: Sep. 20, 2005

(54) PURSE ORGANIZER

(76) Inventor: Terri Newton, 1477 Kathleen Way, Green Cove Springs, FL (US) 32043

( * ) Notice: Subject to any disclaimer, the term of this patent is extended or adjusted under 35 U.S.C. 154(b) by 42 days.

(21) Appl. No.: 10/269,227

(22) Filed: Oct. 11, 2002

(51) Int. Cl.[7] ..... A45C 13/02
(52) U.S. Cl. ..... 150/113; 150/112; 190/110
(58) Field of Search ..... 150/103–106, 150/113, 115; 190/110; 383/111; 119/110

(56) References Cited

U.S. PATENT DOCUMENTS

| | | | | | |
|---|---|---|---|---|---|
| 1,936,358 | A | * | 11/1933 | Herold | 150/117 |
| 2,118,323 | A | * | 5/1938 | Murphy | 312/244 |
| 2,311,847 | A | * | 2/1943 | Long | 150/129 |
| 2,413,465 | A | * | 12/1946 | Ohlsen | 150/117 |
| 2,650,630 | A | * | 9/1953 | Mytinger | 150/111 |
| 2,840,437 | A | * | 6/1958 | Cohen | 312/319.1 |
| 2,893,457 | A | * | 7/1959 | Wilson | 29/254 |
| 2,911,024 | A | * | 11/1959 | Miceli | 150/113 |
| 3,186,463 | A | * | 6/1965 | Yerg | 150/116 |
| 3,186,529 | A | * | 6/1965 | Gilbert | 312/244 |
| 3,286,751 | A | * | 11/1966 | Dishart | 206/38.1 |
| 3,335,775 | A | * | 8/1967 | Adams | 150/113 |
| 3,347,299 | A | * | 10/1967 | Alexander | 150/113 |
| 3,414,033 | A | * | 12/1968 | Tucker | 150/104 |
| 3,521,690 | A | * | 7/1970 | Davis | 206/315.91 |
| 3,533,459 | A | * | 10/1970 | Ody | 150/113 |
| 3,958,616 | A | * | 5/1976 | Beverstock | 150/102 |
| 3,980,116 | A | * | 9/1976 | Edwards | 150/113 |
| 4,098,312 | A | * | 7/1978 | McCain | 150/113 |
| 4,260,004 | A | * | 4/1981 | Domke | 206/316.2 |
| 4,263,951 | A | * | 4/1981 | Siegel | 150/111 |
| 4,718,524 | A | * | 1/1988 | Crumley | 190/110 |
| 4,811,769 | A | * | 3/1989 | Phares | 150/113 |
| 4,907,633 | A | * | 3/1990 | Eckstein | 150/105 |
| D334,661 | S | * | 4/1993 | Kohn | D3/319 |
| 5,207,254 | A | * | 5/1993 | Fromm | 150/104 |
| 5,680,914 | A | * | 10/1997 | Reiser | 190/11 |
| D393,366 | S | | 4/1998 | Kopel | |
| 5,839,553 | A | * | 11/1998 | Dorsam | 190/109 |
| 5,865,233 | A | | 2/1999 | Roegner | |
| D408,146 | S | * | 4/1999 | Briganti | D3/319 |
| 5,983,969 | A | * | 11/1999 | Morgan | 150/104 |
| 6,070,702 | A | * | 6/2000 | Der Kinderen | 190/109 |
| 6,095,213 | A | | 8/2000 | Roegner | |
| 6,179,025 | B1 | | 1/2001 | Sutton | |

FOREIGN PATENT DOCUMENTS

| | | | | |
|---|---|---|---|---|
| EP | 0428451 A1 | * | 5/1991 | 150/113 |

* cited by examiner

*Primary Examiner*—Sue A. Weaver
(74) *Attorney, Agent, or Firm*—Lawrence J. Gibney, Jr.

(57) ABSTRACT

The embodiment of this invention is disclosed, which allows a purse or handbag to be organized. The invention contemplates various sized compartments to accommodate the individual needs of a particular consumer. While the embodiments of this invention have been disclosed, certain modifications may be made, by those skilled in the art, to either the size of the organizer or the compartments in the upper section without violating the spirit of the invention.

2 Claims, 4 Drawing Sheets

PURSE ORGANIZER

CROSS REFERENCE TO RELATED APPLICATIONS

None

STATEMENT REGARDING FEDERALLY SPONSORED RESEARCH

No federal research money was used in the development of this invention.

REFERENCE TO APPENDIX

No appendix accompanies this application

BACKGROUND OF THE INVENTION

This invention relates to the organization of a woman's purse or handbag. Oftentimes, the contents of a woman's purse are disorganized. Items such as keys, lipstick and change are thrown into a purse and eventually find their way to the bottom. This type of organization or more specifically lack of organization leads to items being lost or misplaced in the purse or handbag. In addition to the items being lost, countless hours are wasted trying to find items.

This invention allows organization for any purse or handbag. Individual items may be stored in individual compartments within the purse organizer. The organizer is not part of the purse but may be attached to the bottom of a purse or handbag.

BRIEF SUMMARY OF THE INVENTION

The purse organizer provides individual compartments for individual items. The items, which may be organized, are not necessarily limited to the following but may consist of the following: wallet, sunglasses, cell phone, keys, lipstick, checkbook, loose change and receipts.

The purse organizer may be built in either one or two distinct sections, i.e. as a single organizer or as an organizer with an upper and a lower section.

In the organizer, which consists of two sections the upper section is used to hold the miscellaneous personal items and the lower section is used to collect receipts. It also contains a tray on the bottom of the organizer. The organizer is made from thin plastic. The organizer may also be configured for different shapes and sizes of handbags and/or purses.

In addition, the purse pleaser may be securely fastened to the bottom of the purse by use of velcro strips. The purse organizer may be removed and the contents in the lower section discarded if necessary.

BRIEF DESCRIPTION OF THE DRAWINGS

This invention is further described in connection with the accompanying drawings.

DETAILED DESCRIPTION OF THE EMBODIMENTS

This invention seeks to organize a woman's purse. The invention is an insert for a purse. The device will be made of material that is lightweight yet durable.

In order to accommodate different size and type items the device will be constructed of a top section and a bottom section. The user of the device may use both sections or just one section.

Figure 1:
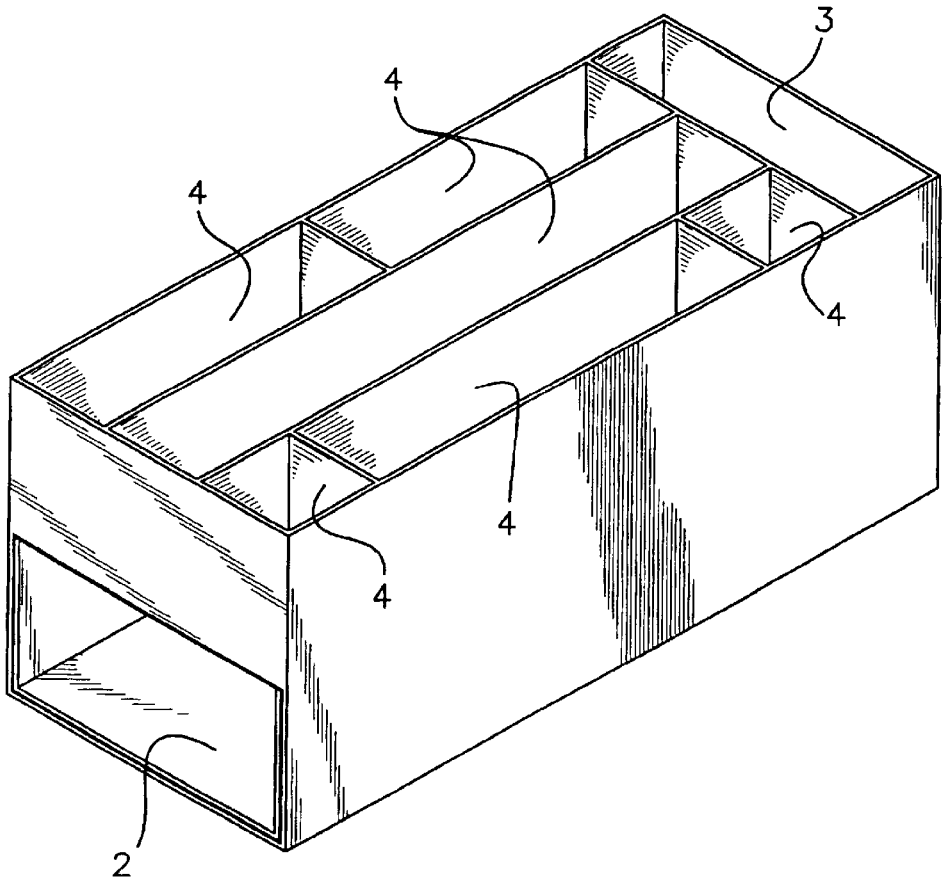
FIG. 1 is a perspective view of the purse organizer showing both the bottom and upper sections.
Figure 2:
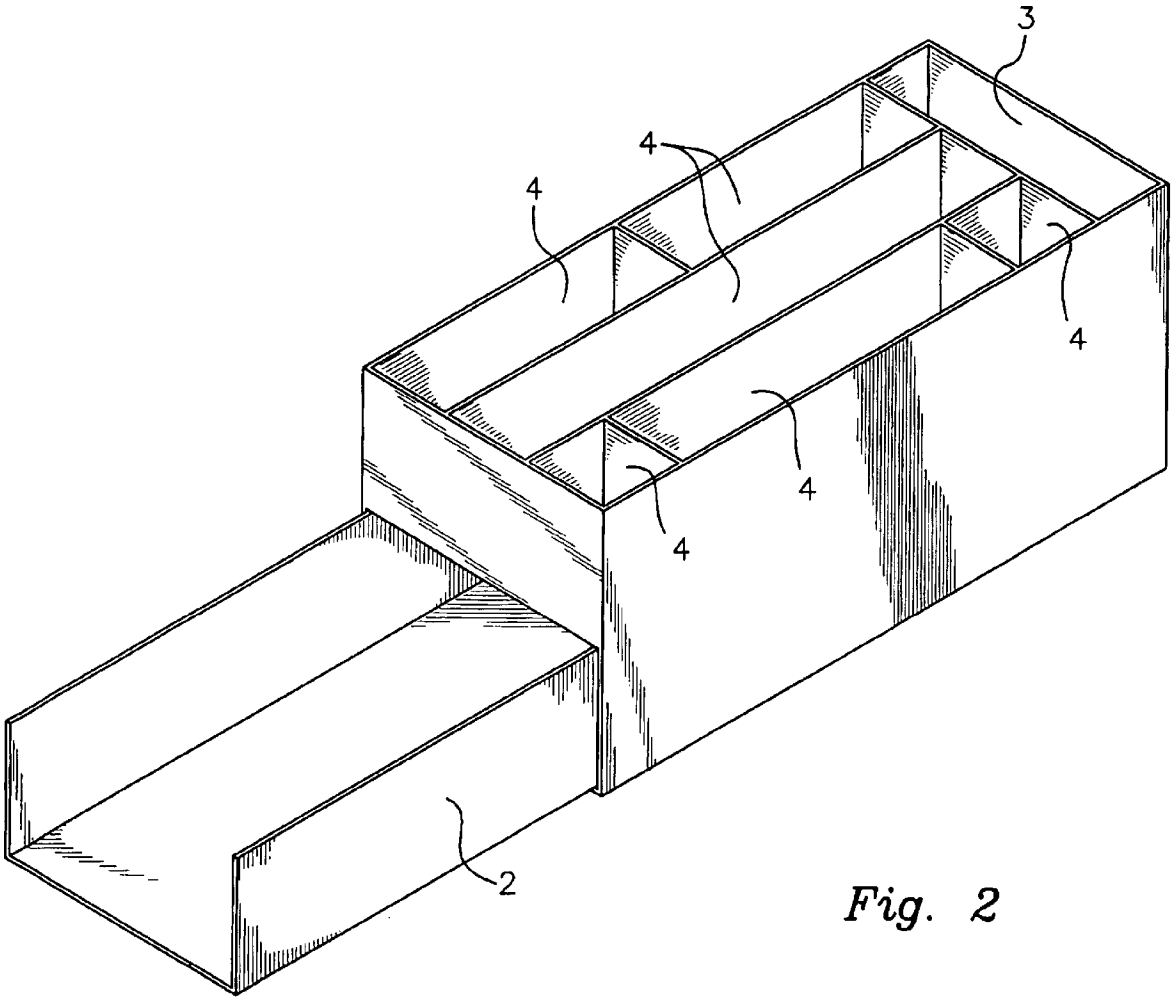
FIG. 2 is an exploded view showing the bottom section as well as the top section.
Figure 3:
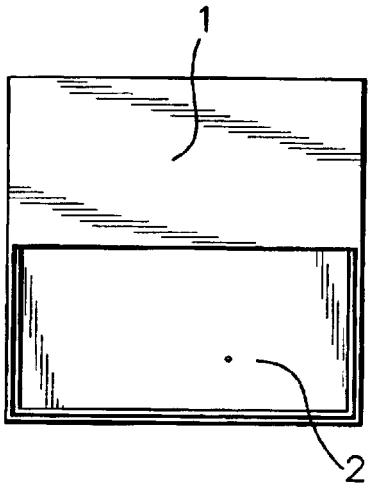
FIG. 3 is the side front view of the purse organizer.
Figure 4:
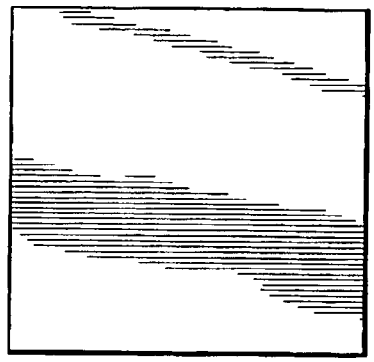
FIG. 4 is the side back view of the purse organizer.
Figure 5:
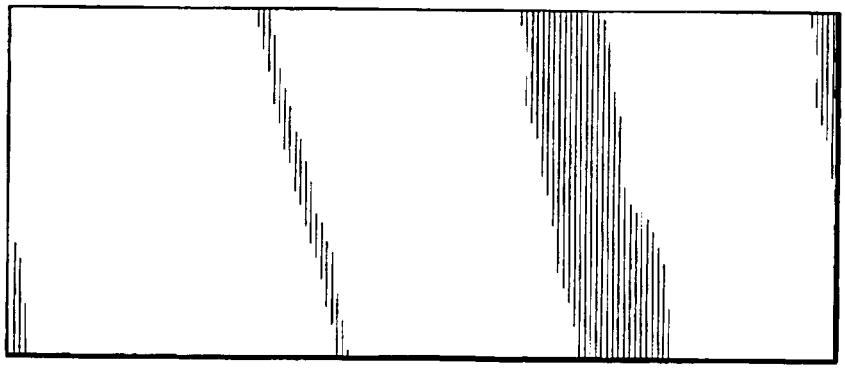
FIG. 5 is the side view of the purse organizer.

The top portion will be equipped with a number of cutout sections 4 to be used to stow a wallet, eyeglasses, cell phone as examples. FIG. 1 The top portion will be joined along the lateral edge of the device to the bottom section. In addition to the separate compartment in the top section on one of the edges of the top section is a hole 3, which will allow the individual to drop items that will be stowed in the bottom section. FIGS. 1, 2, 3

The bottom section 2 will not be equipped with cutout sections but instead is a tray to stow miscellaneous items such as loose change and receipts for example. FIG. 2

The bottom portion and top portion are of equal length and width. The height of the respective portion may differ slightly to be able to be installed in different size purses and the specific needs of the consumer.

This invention is comprised of an upper portion (#1) and lower portion (#2). FIG. 1

Figure 6:
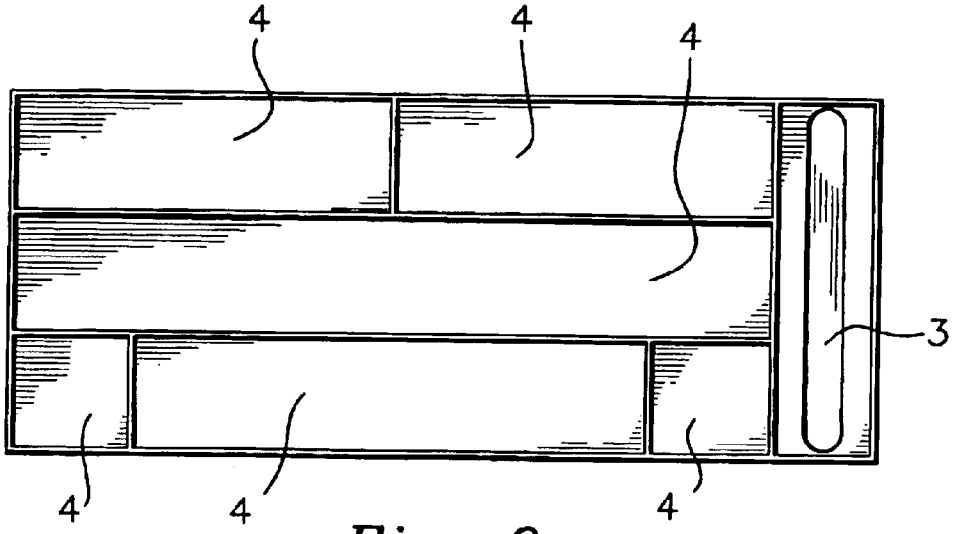
FIG. 6 is a top view of the purse organizer, which shows a sample of the various compartments.
Figure 7:
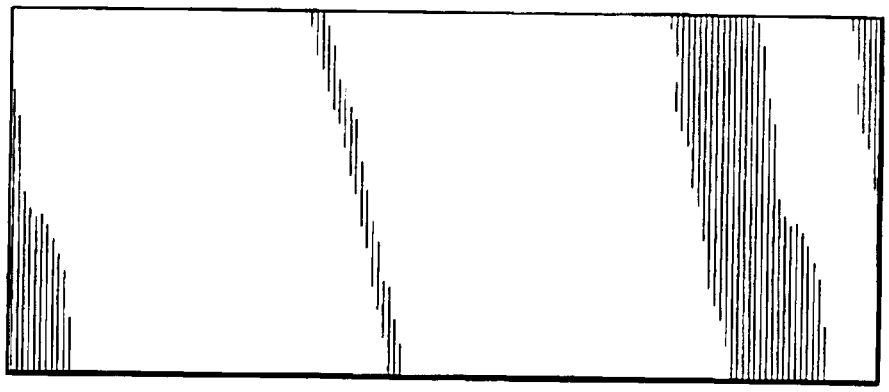
FIG. 7 is the bottom view of the purse organizer.

The lower portion 2 is a device that serves as a tray, which can be removed from the upper portion. There is a hole (#3) in the upper portion, which allows the consumer to drop the receipt, loose paper or loose change into the hole in the upper section. FIGS. 1, 2, 6 Because of the direct communication with the upper portion the receipt, loose paper or loose change is deposited into the lower portion 2. FIGS. 1, 2

The lower portion 2 can then be removed at the end of the day and emptied. It can then be reinserted under the upper portion 1. FIG. 2

The upper portion consists of a series of individual compartments (#4). These compartments may vary depending on the needs of a particular consumer. The compartments are used to store among other items keys, wallet, sunglasses, lipstick checkbook and cell phone. This list is not exhaustive but merely representative.

A space in the upper portion 3 is left open to provide direct communication to the lower portion. The individual can insert loose items such as receipts and loose change through this hole to place items in the lower tray.

What is claimed is:

1. A purse organizer, which is comprised of one piece, which is divided into a top portion and a bottom portion;

wherein a plurality of compartments is provided in the top portion of the device to stow ordinary items in a woman's purse;

wherein a specific hole in the top portion of the device allows loose items to be dropped into the bottom portion of the device;

wherein the bottom portion is provided with a tray for the collection of loose items.

2. The plurality of compartments as described in claim 1 wherein the compartments are shaped and dimensioned to hold common items carried by women.

* * * * *